219-121 3R
8/11/87 OR 4,686,348

United States Patent [19]

Johns et al.

[11] Patent Number: 4,686,348

[45] Date of Patent: Aug. 11, 1987

[54] METHOD FOR HARDFACING VALVES

[75] Inventors: Kent I. Johns, North Vernon; Clinton J. Wohlmuth, Columbus, both of Ind.

[73] Assignee: Cummins Engine Company, Inc., Columbus, Ind.

[21] Appl. No.: 719,138

[22] Filed: Apr. 2, 1985

Related U.S. Application Data

[62] Division of Ser. No. 456,585, Jan. 7, 1983, Pat. No. 4,529,169.

[51] Int. Cl.[4] ..... B23K 9/00

[52] U.S. Cl. ..... 219/121 PY; 219/121 PL; 427/34; 123/41.77

[58] Field of Search ..... 219/121 LF, 121 LE, 219/121 PL, 121 PY, 76.16, 121 LM; 427/34; 123/41.77, 41.85, 188 AA

[56] References Cited

U.S. PATENT DOCUMENTS

| | | | |
|---|---|---|---|
| 2,458,502 | 1/1949 | Cape | 75/171 |
| 2,495,731 | 1/1950 | Jennings | 75/128 |
| 3,147,747 | 9/1964 | Kittelson | 123/188 |
| 3,599,619 | 8/1971 | Kuhn | 123/188 AA |
| 3,649,380 | 3/1972 | Tauschek | 123/188 |
| 4,122,817 | 10/1978 | Matlock | 123/188 AA |
| 4,146,654 | 3/1979 | Guyonnet | 219/121 PL |
| 4,243,867 | 1/1981 | Earle et al. | 219/121 LE |
| 4,262,034 | 4/1981 | Anderson | 219/121 PL |
| 4,371,312 | 2/1983 | Tank | 219/121 PL |

*Primary Examiner*—M. H. Paschall
*Attorney, Agent, or Firm*—Sixbey, Friedman & Leedom

[57] ABSTRACT

A poppet-type valve having a circumferential seating face including an annular seating area extending between inner and outer radial limits, a circumferential groove formed in the seating face and hardfacing material in the groove, the groove extending radially inwardly from the valve head periphery a sufficient distance beyond the inner radial limit that high temperature deposition of hardfacing material within the groove will not cause substantial dilution by valve head material of the composition of the hardfacing material within the annular seating area.

6 Claims, 2 Drawing Figures

METHOD FOR HARDFACING VALVES

This application is a division of application Ser. No. 456,585, filed Jan. 7, 1983, now U.S. Pat. No. 4,529,169.

TECHNICAL FIELD

The present invention relates to hardfaced valves for internal combustion engines and, more particularly, to methods of making such valves.

BACKGROUND ART

The valve bodies of internal combustion engine valves are typically subjected to elevated temperatures and corrosive action as a result of exposure to exhaust and combustion gases and generally experience considerable wear on their seating surfaces. For these reasons, the valve bodies are formed of durable alloys, such as stainless steel, and are provided with corrosion- and wear-resistant properties either by special treatment of the seating surfaces or by "armoring", "cladding" or "facing" the seat-forming portion with heat-, wear- and corrosion-resistant materials, frequently referred to as hardfacing materials. It is, therefore, common practice, particularly in the manufacture of exhaust valves to hardface the valve on its frustoconical seating surfaces with a corrosion and abrasion resistant alloy to protect the valve face and enhance the durability of the valve. In a typical case, the valve body is formed of an austenitic or martensitic steel or a nickel-chromium base alloy and the facing material is a nickel-chromium, nickel-chromium-cobalt or cobalt-chromium-tungsten base alloy, such as one of the Stellite alloys.

The hardfacing material is typically applied to the valve seating surface by various high temperature techniques, such as by depositing the material in a liquid state and fusing it to the surface or by applying the material in the form of a preformed ring and bonding it to the surface by techniques such as plasma arc or oxyacetylene gas or shielded arc electric welding. According to one particularly desirable method for applying a corrosion- and wear-resistant alloy to the seating surface of an exhaust valve, the frustoconical seating surface is first channeled, fluted, grooved or otherwise formed with a shallow annular recess or depression and the hardfacing alloy is placed or deposited therein for bonding to the groove surfaces by one of the aforementioned techniques or any other suitable metal deposition technique.

It has been found that at the very high temperatures used during oxyacetylene or other bonding of the hardfacing alloy to the groove surfaces, and particularly at the high temperatures experienced using plasma arc techniques, there occurs an undesirable melting of the valve body in the areas radially inward of and adjacent to the groove formed in the seating surface of the valve body. This melting of the valve body causes and encourages the valve body material to diffuse into and dilute the hardfacing alloy composition adjacent the melted areas. The diluted hardfacing material exhibits a notable deterioration in corrosion and wear resistance which adversely affects the ability of the material to perform its intended function.

It is therefore the purpose of the present invention to overcome this previously encountered material dilution problem, to provide an improved method of hardfacing the seating surfaces of internal combustion engine valves with wear- and corrosion-resistant alloys and to provide an improved valve for internal combustion engines having wear- and corrosion-resistant seating surfaces.

DISCLOSURE OF THE INVENTION

In one aspect of the present invention this is accomplished by providing a tulip shaped, poppet-type valve having a generally circumferential seating face including an annular seating area, a circumferential groove formed in the seating face and hardfacing material in the groove, the groove extending radially inwardly a sufficient distance beyond the inner radial extent of the annular seating area that high temperature deposition of hardfacing material within the groove will not cause substantial dilution of the hardfacing material composition within the annular seating area.

In another aspect of the present invention this is accomplished by providing a method for hardfacing the seating face of a tulip shaped, poppet-type valve for forming an annular seating area of substantially undiluted hardfacing material, including the steps of forming a circumferential groove in the seating face, said groove extending radially inwardly a sufficient distance beyond the inner radial extent of the annular seating area that high temperature deposition of hardfacing material within the groove will not cause substantial dilution of the hardfacing material composition within the annular seating area, and depositing hardfacing material in the groove.

In a particularly preferred aspect of the invention the circumferential groove communicates at its outer radial extent with the periphery of the valve head and the groove includes a floor portion communicating with the periphery of the valve head and an inclined wall portion extending radially inwardly from the floor portion and intersecting the seating face at a point radially inwardly of the inner radial-extent of the annular seating area.

BRIEF DESCRIPTION OF THE DRAWINGS

The invention will be better understood from the following description taken in conjunction with the accompanying drawings in which.

BEST MODE FOR CARRYING OUT THE INVENTION

Figure 1:
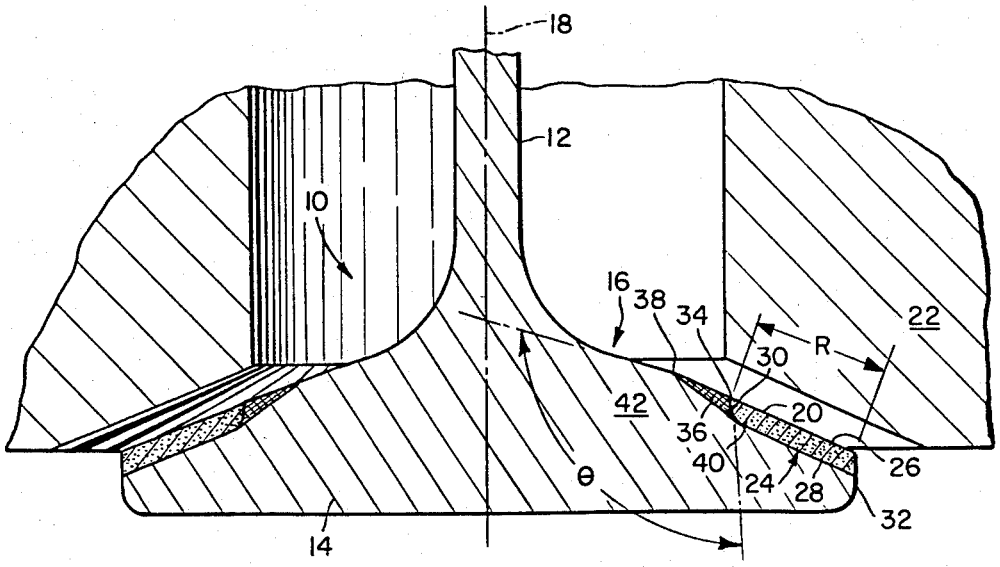
FIG. 1. (PRIOR ART.)
FIG. 1 is a cross-sectional view of an internal combustion engine exhaust valve manufactured in accordance with the teachings of the prior art.

Referring to FIG. 1, reference numeral 10 indicates generally a poppet-type exhaust valve of the well known "mushroom" or "tulip" configuration including a valve stem portion 12 and a valve head 14. The head includes a face 16 which is inclined to the axis 18 of the stem portion 12 to yield a generally frustoconical seating face 20 engageable with the cylinder head 22 of the engine. A generally circumferential annular groove or recess 24 is machined into seating face 20 and filled with a wear- and corrosion-resistant cladding or facing material 26 bonded to the surfaces of groove 24 to permit seating face 20 to better withstand the wear and high temperature, corrosive environment to which it is subjected in normal use. Typically, groove 24 includes a floor portion 28 generally parallel to seating face 20 which extends radially inwardly from the periphery 32 of valve head 14 and a concave wall portion 30, which curves gently upward from floor portion 28 to intersect seating face 20 at 34 and to define an effective annular seating area of radial length R having its outer radial extent at periphery 32 and its inner radial extent at intersection 34. As indicated previously, it is well known for hardfacing material 26 to be bonded to the surfaces of groove 24 by any of a number of well known high temperature techniques, including heat fusing a molten liquid deposited in the groove or welding a preformed ring placed within the groove. Whatever technique is used, valve head 14 is subjected to very high temperature heating, at least in the areas immediately adjacent groove 24. It has been found that this severe local heating causes a melting of the valve head material in cross-hatched generally triangular region 36, i.e., generally in the area radially inward of concave wall portion 30 and extending within valve body 14 from a maximum depth adjacent concave wall portion 30 to seating face 20 at the innermost radial extent 38 of region 36. This localized melting causes the material of valve head 14 in this region to diffuse or otherwise move into and to admix or alloy with or to otherwise contaminate or dilute the hardfacing composition within region 40 adjacent concave wall portion 30 and to substantially and adversely affect the physical and metallurgical properties of the hardfacing material within this region 40. Attending this dilution is a notable diminution in the wear resistance of the hardfacing material and its ability to withstand high temperatures and corrosive environments and, therefore, a marked and notable reduction in its ability to perform its intended function.

The extent of melted region 36 in valve head 14 and of diluted region 40 in hardfacing material 26 appears to depend upon many interrelated factors. Primarily, however, it appears to be a function of the physical properties of the valve head and hardfacing materials, the method of deposition of the hardfacing material and the relative configuration of the groove and seating face. Specifically, the extent of the respective regions depends, in the first instance, upon the method of deposition since the high temperatures to which the materials are subjected are determined by the method chosen. Closely related to this, of course, is the selection of valve head and hardfacing materials in that the extent of the regions depends upon the melting temperature of these materials and their flowability. Thus, for any selected method of deposition the lower melting the valve head and hardfacing materials, the greater the extent of melting and, in most cases, the greater the tendency of the valve head material to flow into and dilute the hardfacing material. On the other hand a higher melting temperature valve head material will melt to a lesser degree and have less of a tendency to flow into and dilute the hardfacing material. In most applications, however, structural performance and economic considerations are the major factors leading to a choice of materials and deposition techniques and it would be extremely undesirable for the hardfacing material dilution problem to dictate an otherwise unnecessary compromise in material or process selection.

Figure 2:
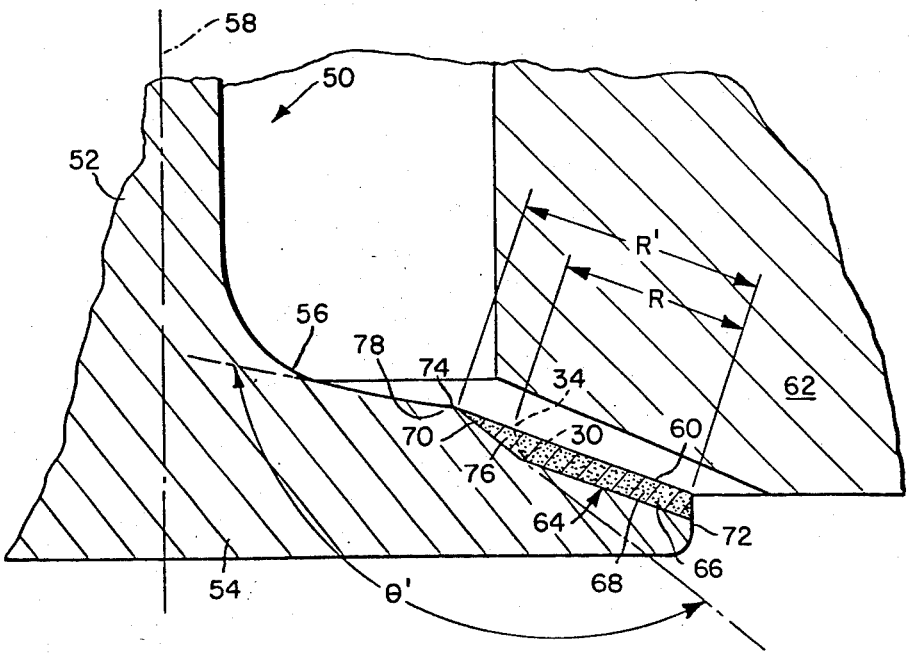
FIG. 2 is an enlarged fragmentary cross-sectional view of an internal combustion engine exhaust valve manufactured in accordance with the present invention.

The other important factor in determining the extent of regions 36 and 40 appears to be the relative configuration of groove 24 and seating face 20. More specifically, it can be seen from FIG. 1 that concave wall portion 30 and seating face 20 define at their intersection 34 a generally pointed substantially triangular projection 42, disposed within valve head 14 radially inwardly of concave wall portion 30 and below seating face 20 and having an included apex angle $\theta$ at intersection 34 which is generally obtuse. Depending upon the angle of inclination between valve stem axis 18 and seating face 20 and the configuration of the groove at intersection 34, it will be appreciated that included apex angle can vary from about 90° to less than about 180°, although it is frequently only slightly greater than 90°. It has been found to be generally the case, material selection and deposition technique notwithstanding, that the smaller the angle $\theta$ the more subject is the substantially triangular projection 42 to melting and the more severe is the potential hardfacing material dilution problem. Therefore, in accordance with the present invention, the dilution of hardfacing material within the effective annular seating area of radial length R can be prevented by configuring groove 24 as shown in FIG. 2 which illustrates a poppet-type exhaust valve 50 manufactured in accordance with the present invention.

Valve 50 consists of a valve stem portion 52 and a valve head 54, the valve head including a face 56 which is inclined to stem portion axis 58 to yield a generally frustoconical seating face 60 engageable with cylinder head 62 of the engine. As in prior art poppet-type valves a generally circumferential annular groove 64 is machined into seating face 60 and filled with a wear- and corrosion-resistant hardfacing material 66. The groove 64 of the present invention includes a floor portion 68 generally parallel to seating face 60 which extends radially inwardly from the periphery 72 of the valve head 54 and an inner inclined wall portion 70 extending from floor portion 68 to intersect seating face 60 at 74, a point on the seating face spaced radially inwardly of intersection 34 of the prior art valves (shown in phantom), to define a hardfacing area of radial length R' having its outer radial extent at periphery 72 and its inner radial extent at intersection 74. Desirably, intersection 74 is at least substantially coincident with or disposed radially inwardly of innermost radial extent 38 of region 36 in FIG. 1. This groove configuration of the present invention increases the prior art groove cross-sectional area by an amount equal to generally triangular section 76 bounded by inner inclined wall portion 70, seating face 60 and concave wall portion 30 (shown in phantom). At the same time, seating face 60 and inclined wall portion 70 define an included apex angle $\theta'$ at intersection 74 which is substantially greater than included apex angle $\theta$ of the prior art, shown in FIG. 1. Included apex angle $\theta'$ is substantially greater than 90° and less than 180°. This markedly reduces the susceptibility to melting of the substantially triangular projection 78 of valve head 14 which is disposed within valve head 54 radially inwardly of inclined wall portion 70 and below seating face 20 and which includes apex $\theta'$ angle.

Hardfacing material 66 may be deposited within groove 64 by any of the same techniques which have previously been employed. However, the increased resistance to melting conferred on the groove-seating face configuration of the present invention by virtue of increased apex angle $\theta'$ and the increased mass area of the triangular projection 78 of valve head 54 which includes this angle $\theta'$ permits the safe use of somewhat higher temperature, improved techniques such as plasma arc deposition. Moreover, even to the extent that some melting may occur within triangular projection 78 and valve head material may diffuse or be transported into the adjacent hardfacing material, the resulting dilution, if any, will be confined to triangular section 76 of groove 64 which, although within the hardfacing material in groove 64, is outside of the effective annular seating area of radial length R. Therefore any diminution of physical and metallurgical properties of the hardfacing material within triangular section 76 is of no consequence in connection with the properties of the undiluted hardfacing material within the effective annular seating area.

INDUSTRIAL APPLICABILITY

The improved process of the present invention for manufacturing hardfaced valves and the resulting valves having undiluted hardfacing material within their effective annular seating areas are broadly useful in connection with the manufacture of all engines requiring the use of hardfaced seating faces on exhaust or other valves. Just as the extent of the melted region in the valve head and of the diluted region in the adjacent hardfacing material is a function of many factors, the determination of the cross-sectional size and/or shape of the additional material which must be machined from the valve head to form groove 64, i.e. of generally triangular section 76, is determined by the physical properties of the valve head and hardfacing materials, the method of deposition of the hardfacing material and the relative configuration of the groove and seating face. As a general matter, the lower melting the materials, the higher temperature the deposition process and/or the smaller the included angle $\theta'$, the larger will generally triangular section 76 have to be to reduce the likelihood that valve head material will dilute the hardfacing material within the effective annular seating area. It will, therefore, be appreciated that in view of the large number of variables no mathematical formulation or precise rule can be applied to ascertain the effective size of generally triangular section 76. Rather, the effective size is determined from and after the materials and deposition technique have been selected.

It is essential that groove 64 be extended radially inwardly a sufficient distance beyond the inner radial extent of the effective annular seating area that high temperature deposition of hardfacing material within groove 64, including triangular section 76, will not cause melting of the adjacent valve head material with resulting substantial dilution of the composition of the hardfacing material within the effective annular seating area of the groove. While the amount of additional valve head material which must be removed in forming groove 64 in order to achieve this result will vary depending, as indicated, upon the selected materials and the chosen deposition technique, by way of example, where the valve head is formed of SS212N, the hardfacing material is Stellite, the groove depth is about 0.040 inches from seating face to groove floor, the concave wall portion has a radius of curvature of about 0.06 inches, the radial length of the effective annular seating area is about 0.12 inches, the angle of inclination between the valve stem axis and the seating face is about 150° and the Stellite hardfacing is deposited by plasma arc techniques, the cross-sectional area of removed triangular section 76 is about 0.0007 $in^2$.

We claim:

1. In a method for hardfacing the seating face of the valve head of a poppet-type valve for forming an annular seating area thereon extending from a first radial location between the valve stem and the outer periphery of the valve head, to a second radial location, spaced radially outwardly of the first radial location toward the outer periphery, including the steps of forming a circumferential groove in said seating face and depositing hardfacing material at high temperatures in said groove, the improvement which comprises forming said groove in such a manner that its inner radial limit at the seating face is radially inwardly of said first radial location a sufficient distance that high temperature deposition of hardfacing material within said groove will not cause substantialy dilution by valve head material of the composition of the hardfacing material within said annular seating area.

2. A method, as claimed in claim 1, wherein said second radial location limit comprises the outer periphery of said valve head.

3. A method, as claimed in claim 2, wherein said groove is formed with a floor portion extending radially inwardly from said valve head outer periphery and substantially parallel to said seating face and an inclined inner wall portion extending radially inwardly from said floor portion and intersecting said seating face at a point radially inwardly of said first radial location.

4. A method, as claimed in claim 3, wherein said inclined inner wall portion is formed to defined at its intersection with said seating face, a pointed, generally triangular projection having an included apex angle which is substantially greater that 90° and less that 180°.

5. A method, as claimed in claim 1, wherein said hardfacing material is deposited in said groove by plasma arc deposition.

6. A method, as claimed in claim 3, wherein said hardfacing material is deposited in said groove by plasma arc deposition.

* * * * *